US010151181B2

(12) United States Patent
Lopez et al.

(10) Patent No.: US 10,151,181 B2
(45) Date of Patent: Dec. 11, 2018

(54) SELECTABLE SWITCH TO SET A DOWNHOLE TOOL

(71) Applicant: Schlumberger Technology Corporation, Sugar Land, TX (US)

(72) Inventors: Pedro Alejandro Hernandez Lopez, Sugar Land, TX (US); Kenneth Randall Goodman, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 180 days.

(21) Appl. No.: 15/190,888

(22) Filed: Jun. 23, 2016

(65) Prior Publication Data

US 2017/0370194 A1 Dec. 28, 2017

(51) Int. Cl.

| | |
|---|---|
| ***E21B 23/06*** | (2006.01) |
| ***E21B 43/1185*** | (2006.01) |
| ***E21B 33/12*** | (2006.01) |

(52) U.S. Cl.

CPC ..... *E21B 43/1185* (2013.01); *E21B 23/065* (2013.01); *E21B 33/12* (2013.01)

(58) Field of Classification Search

CPC .... E21B 43/11; E21B 43/116; E21B 43/1185; E21B 43/11857; E21B 23/01; E21B 23/06

See application file for complete search history.

(56) References Cited

U.S. PATENT DOCUMENTS

| | | | | |
|---|---|---|---|---|
| 3,398,803 | A | 8/1968 | Leutwyler | |
| 3,717,794 | A | 2/1973 | Yates | |
| 4,208,966 | A * | 6/1980 | Hart | E21B 43/11857 102/310 |
| 6,105,688 | A * | 8/2000 | Vaynshteyn | F42D 1/055 175/4.54 |
| 7,520,323 | B2 * | 4/2009 | Lerche | E21B 41/00 166/250.01 |
| 7,565,927 | B2 | 7/2009 | Gerez et al. | |
| 8,074,737 | B2 * | 12/2011 | Hill | E21B 43/1185 102/312 |
| 8,091,477 | B2 | 1/2012 | Brooks et al. | |
| 8,230,788 | B2 | 7/2012 | Brooks et al. | |
| 8,264,814 | B2 | 9/2012 | Love et al. | |
| 8,607,863 | B2 * | 12/2013 | Fripp | E21B 41/00 166/250.01 |

(Continued)

OTHER PUBLICATIONS

International Search Report and Written Opinion issued in the related PCT Application PCT/US2017/037360, dated Sep. 7, 2017 (10 pages).

*Primary Examiner* — Kenneth L Thompson

(57) ABSTRACT

A perforating gun includes a carrier, an explosive charge positioned within the carrier, a detonator positioned within the carrier, and a switch positioned within the carrier. The detonator detonates the explosive charge when the detonator receives power. The switch actuates between at least a first position and a second position. The switch transmits power to the detonator when the switch is in the first position, and the switch transmits power to a pyrotechnic device when the switch is in the second position. The pyrotechnic device detonates or deflagrates when the pyrotechnic device receives power.

18 Claims, 4 Drawing Sheets

(56) References Cited

U.S. PATENT DOCUMENTS

| | | | | |
|---|---|---|---|---|
| 8,636,062 | B2 * | 1/2014 | Fripp | E21B 47/12 166/250.01 |
| 8,695,506 | B2 * | 4/2014 | Lanclos | E21B 43/1185 102/206 |
| 9,464,508 | B2 * | 10/2016 | Lerche | E21B 41/00 |
| 9,518,454 | B2 * | 12/2016 | Current | E21B 43/11 |
| 9,556,725 | B2 * | 1/2017 | Fripp | E21B 47/12 |
| 2002/0148611 | A1 | 10/2002 | Williger et al. | |
| 2011/0090091 | A1 | 4/2011 | Lerche et al. | |
| 2012/0180678 | A1 | 7/2012 | Kneisl | |
| 2012/0250208 | A1 | 10/2012 | Love et al. | |
| 2016/0115753 | A1 * | 4/2016 | Frazier | E21B 23/06 166/53 |

* cited by examiner

SELECTABLE SWITCH TO SET A DOWNHOLE TOOL

BACKGROUND

A perforating string includes one or more perforating guns, a setting tool, and a plug. The perforating guns may each include a switch having at least two positions. For example, when the switch in an "upper" perforating gun in the perforating string is in the first position, the switch may connect a computing system at the surface to a switch in a "lower" perforating gun in the perforating string. When the switch in the upper perforating gun is in the second position, the switch may cause a detonator in the upper perforating gun to detonate an explosive charge.

When the switch in the lower perforating gun is in the first position, the switch may connect the computing system to a switch in the setting tool, which may be used to set the plug. When the switch in the lower perforating gun is in the second position, the switch may cause a detonator in the lower perforating gun to detonate an explosive charge. Thus, as may be seen, multiple switches are used during the operation of the perforating string. However, as the number of switches in the perforating string increases, so to do the odds that an electrical failure may occur downhole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A perforating gun is disclosed. The perforating gun includes a carrier, an explosive charge positioned within the carrier, a detonator positioned within the carrier, and a switch positioned within the carrier. The detonator detonates the explosive charge when the detonator receives power. The switch actuates between at least a first position and a second position. The switch transmits power to the detonator when the switch is in the first position, and the switch transmits power to a pyrotechnic device when the switch is in the second position. The pyrotechnic device detonates or deflagrates when the pyrotechnic device receives power.

A downhole tool is also disclosed. The downhole tool includes a perforating gun that includes a carrier, an explosive charge positioned within the carrier, a detonator positioned within the carrier, and a switch positioned within the carrier. The detonator detonates the explosive charge when the detonator receives power. The switch actuates between at least a first position and a second position. The switch transmits power to the detonator when the switch is in the first position. The switch transmits power to an ignitor when the switch is in the second position. The downhole tool also includes a setting tool coupled the perforating gun. The setting tool has the ignitor positioned therein. The downhole tool further includes a plug coupled to the setting tool. The ignitor causes the plug to actuate from a first state to a second state when the ignitor receives power.

A method for operating a downhole tool is also disclosed. The method includes running a downhole tool into a wellbore. The downhole tool includes a first gun, a setting tool, and a plug. A first signal is transmitted from a computing system to a first switch in the first perforating gun. The first switch actuates into a first position that transmits power to a first pyrotechnic device in response to receiving the first signal. The first pyrotechnic device causes the plug to actuate from a first state to a second state when the first pyrotechnic device receives power. A second signal is transmitted from the computing system to the first switch in the first perforating gun. The first switch actuates into a second position that transmits power to a second pyrotechnic device in response to receiving the second signal. The second pyrotechnic device causes a charge in the first perforating gun to explode when the second pyrotechnic device receives power.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the system and method disclosed herein may be practiced without these specific details.

Figure 1:
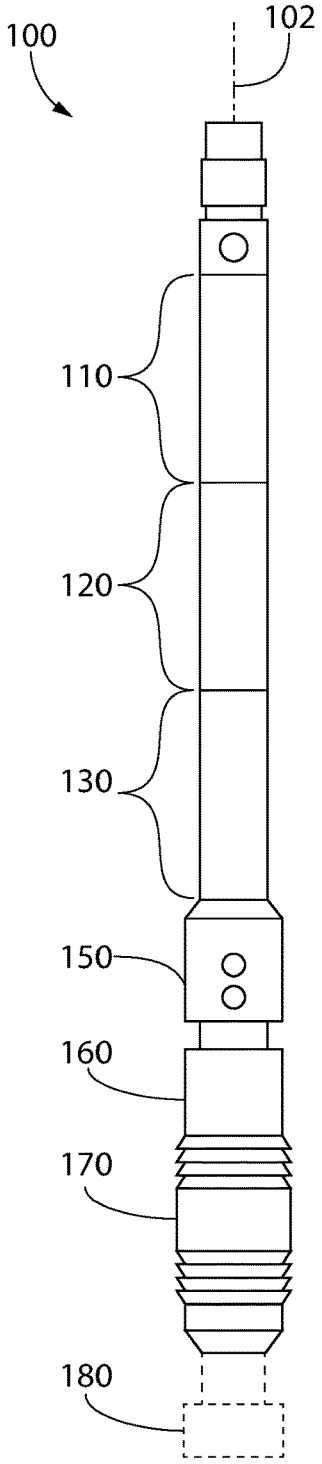
FIG. 1 illustrates a schematic side view of a downhole tool, according to an embodiment.

FIG. 1 illustrates a schematic side view of a downhole tool 100, according to an embodiment. The downhole tool 100 may be or include a perforating string. More particularly, the downhole tool 100 may include one or more perforating guns (three are shown: 110, 120, 130) that are axially-offset from one another with respect to a central longitudinal axis 102 through the downhole tool 100.

The downhole tool 100 may also include an adapter 150. As shown, the adapter 150 may be coupled to and positioned below the lowermost perforating gun 130. In one embodiment, the adapter 150 and/or the components therein may be integral with the lowermost perforating gun 130.

The downhole tool 100 may also include one or more setting tools (one is shown: 160) and one or more plugs (one is shown: 170). The setting tool 160 may be positioned below the perforating guns 110, 120, 130 and the adapter 150, and the plug 170 may be positioned below the setting tool 160. As described in greater detail below, when the setting tool 160 receives power from the surface, the setting tool 160 may actuate the plug 170 from a first, retracted state into a second, expanded state. Fluid may pass axially-through an annulus formed between the plug 170 and a surrounding tubular member (e.g., casing, liner, wellbore wall) when the plug 170 is in the first state. The plug 170 may expand radially-outward to contact the surrounding tubular member when the plug 170 actuates from the first state into the second state. The annulus may no longer be present when the plug 170 is in the second state. As such, the plug 170 may isolate a first (e.g., upper) portion of the wellbore from a second (e.g., lower) portion of the wellbore.

Figure 2:
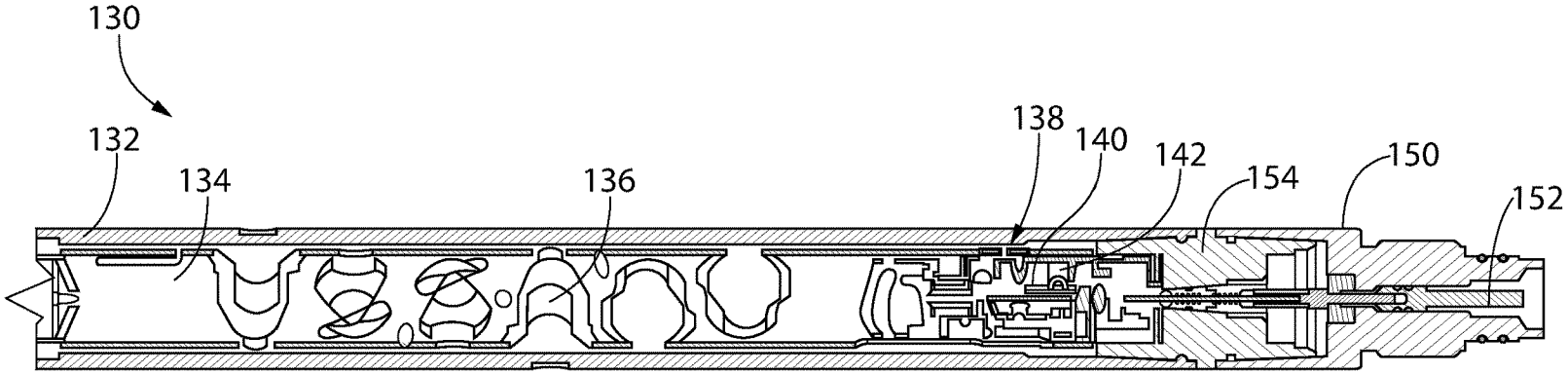
FIG. 2 illustrates a cross-sectional side view of a perforating gun in the downhole tool, according to an embodiment.

FIG. 2 illustrates a cross-sectional side view of the lowermost perforating gun 130 and the adapter 150 in the downhole tool 100, according to an embodiment. In other embodiments, the perforating gun 130 shown in FIG. 2 may not be the lowermost perforating gun 130; rather, it may be the intermediate perforating gun 120 or the uppermost perforating gun 110.

The perforating gun 130 may include a housing (referred to as a "carrier") 132. The carrier 132 may be a hollow tubular member. A loading tube 134 may be positioned within the carrier 132. The loading tube 134 may have one or more explosive charges 136 positioned therein. The charges 136 may be axially and/or circumferentially-offset from one another with respect to the central longitudinal axis 102 through the downhole tool 100. The charges 136 may be configured to perforate the surrounding tubular member (e.g., casing, liner, wellbore wall) in preparation for production.

A body 138 may also be positioned within the carrier 132. As shown, the body 138 may be positioned below the charges 136. The body 138 may have one or more switches (one is shown: 140) coupled thereto and/or positioned therein. The switch 140 may have two or more positions. When the switch 140 is in a first, default position, the switch 140 is not connected to a pyrotechnic device or another switch. When the switch 140 is in a second position, the switch 140 may connect a line extending from a computing system 400 at the surface (see FIG. 4) to a first pyrotechnic device 152. As used herein, a "pyrotechnic device" refers to detonator configured to initiate a detonation or an ignitor configured to start a deflagration. In one example, the first pyrotechnic device 152 may be or include an ignitor. The ignitor 152 may be positioned in the adapter 150, the setting tool 160 (as shown). When the switch 140 connects the computing system 400 to the ignitor 152, power from the surface may be transmitted from the computing system 400, through the switch 140, and to the ignitor 152. In response to receiving the power, the ignitor 152 may cause the setting tool 160 to actuate the plug 170 from the first state to the second state. In at least one embodiment, there may be no intermediate switches in the path between the switch 140 and the first pyrotechnic device (e.g., the ignitor) 152.

When the switch 140 is in a third position, the switch 140 may connect the computing system 400 at the surface to a second pyrotechnic device 142. The second pyrotechnic device 142 may be a different type of pyrotechnic device than the first pyrotechnic device 152. In one example, the second pyrotechnic device 142 may be or include a detonator 142. As shown, the detonator 142 may be positioned within the body 138. When the switch 140 connects the computing system 400 to the detonator 142, power may be transmitted from the computing system 400, through the switch 140, and to the detonator 142. In response to receiving power, the detonator 142 may cause one of the charges 136 to explode to perforate the surrounding tubular member.

In at least one embodiment, the switch 140 may also include a fourth position. When the switch is in the fourth position, the switch 140 may connect the computing system 400 to another device 180 (see FIG. 1) in the downhole tool 100. The device 180 may be or include a motor, a release mechanism, or a measurement tool (e.g., a thermometer, a pressure gauge, etc.). In at least one embodiment, two or more switches may be used instead of a single switch 140 switching between three or four positions.

The adapter 150 may be coupled to the carrier 132 and/or the body 138. As shown, in at least one embodiment, a connector 154 may be coupled to and positioned between the carrier 132 and/or the body 138 on one side and the adapter 150 on the other side.

The setting tool 160 may be coupled to the adapter 150. The body 138 may be a "plug-and-play" component. More particularly, the switch 140 may be placed into communication with computing system 400 when the body 138 is inserted into and/or coupled to the carrier 132 without the manual connection of any wires or cables. The switch 140 may be placed into communication with the first pyrotechnic device (e.g., the ignitor) 152 when the adapter 150 and/or the setting tool 160 are coupled to the body 138 without the manual connection of any wires or cables. The switch 140 may be in communication with the second pyrotechnic device (e.g., the detonator) 142 before, during, and/or after the body 138 is inserted into and/or coupled with the carrier 132, without the manual connection of any wires or cables, because the switch 140 and the second pyrotechnic device (e.g., the detonator) 142 may both be positioned within the body 138.

Figure 3:
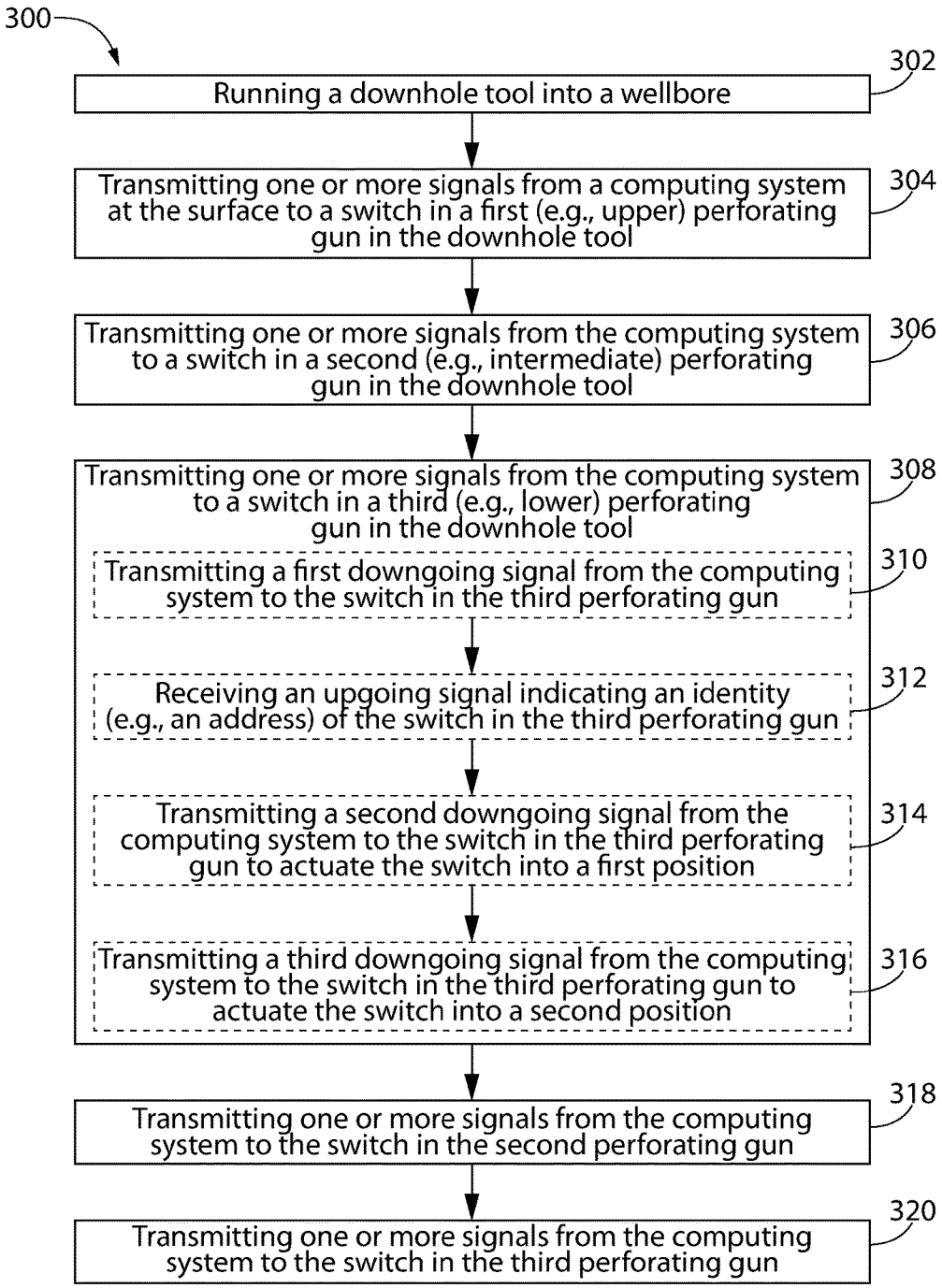
FIG. 3 illustrates a flowchart of a method for operating the downhole tool, according to an embodiment.

FIG. 3 illustrates a flowchart of a method 300 for operating the downhole tool 100, according to an embodiment. As will be appreciated, in other embodiments, the downhole tool 100 may have a different number of perforating guns 110, 120, 130, setting tools 160, and plugs 170, and the method 300 may vary accordingly.

The method 300 may include running the downhole tool 100 into a wellbore, as at 302. When the downhole tool 100 is in the desired location in the wellbore, the method 300 may include transmitting one or more signals from a computing system at the surface to a switch in the first (e.g., upper) perforating gun 110, as at 304. For example, a first downgoing signal may be transmitted from the computing system 400 to the switch in the first (e.g., upper) perforating gun 110. In response to this first downgoing signal, the computing system 400 may receive an upgoing signal indicating an identity (e.g., an address) of the switch in the first (e.g., upper) perforating gun 110. The computing system 400 may then transmit a second downgoing signal to the switch in the first (e.g., upper) perforating gun 110. In response to this second downgoing signal, the switch may actuate from a first, default position to a second position. In the first position, the switch is not connected to a pyrotechnic device or a switch in a component (e.g., perforating gun) therebelow. In the second position, the switch places the computing system 400 in communication with the switch in the second (e.g., intermediate) perforating gun 120, as discussed below.

The method 300 may also include transmitting one or more signals from the computing system 400, through the switch in the first perforating gun 110, to the switch in the second (e.g., intermediate) perforating gun 120, as at 306. For example, a first downgoing signal may be transmitted from the computing system 400 to the switch in the second (e.g., intermediate) perforating gun 120. In response to this first downgoing signal, the computing system 400 may receive an upgoing signal indicating an identity (e.g., an address) of the switch in the second (e.g., intermediate) perforating gun 120. The computing system 400 may then transmit a second downgoing signal to the switch in the second (e.g., intermediate) perforating gun 120. In response to this second downgoing signal, the switch may actuate from a first, default position to a second position. In the first position, the switch is not connected to a pyrotechnic device or a switch in a component (e.g., perforating gun) therebelow. In the second position, the switch places the computing system 400 in communication with the switch 140 in the third (e.g., lower) perforating gun 130, as discussed below.

The method 300 may also include transmitting one or more signals from the computing system 400 to the switch 140 in the third (e.g., lower) perforating gun 130, as at 308. For example, the method 300 may include transmitting a first downgoing signal from the computing system 400, through the switches in the first and second perforating guns 110, 120, to the switch 140 in the third (e.g., lower) perforating gun 130, as at 310. In response to this first downgoing signal, the method 300 may include the computing system 400 receiving an upgoing signal indicating an identity (e.g., an address) of the switch 140 in the third (e.g., lower) perforating gun 130, as at 312. The method 300 may then include transmitting a second downgoing signal from the computing system 400 to the switch 140 in the third (e.g., lower) perforating gun 130, as at 314. In response to this second downgoing signal, the switch 140 may actuate from a first, default position into a second position. In the first position, the switch 140 is not connected to a pyrotechnic device or a switch in a component (e.g., setting tool 160) therebelow. In the second position, the switch 140 connects the computing system 400 with the first pyrotechnic device (e.g., the ignitor) 152. In another embodiment, a single second downgoing signal may not actuate the switch 140 (e.g., for safety reasons), and the computing system 400 may instead transmit two separate second downgoing signals that cause the switch 140 to actuate into the second position after both second downgoing signals are received.

Once the switch 140 in the third (e.g., lower) perforating gun 130 actuates into the second position, power may be supplied from the surface, through the switch 140, and to the first pyrotechnic device (e.g., the ignitor) 152. When the first pyrotechnic device (e.g., the ignitor) 152 receives the power, the first pyrotechnic device (e.g., the ignitor) 152 may cause the setting tool 160 to actuate the plug 170 from the first state to the second state. More particularly, the first pyrotechnic device (e.g., the ignitor) 152 may deflagrate. This may produce a gas that drives a piston in the setting tool 160 that actuates the plug 170 from the first state to the second state.

After the plug 170 is actuated, the method 300 may include transmitting a third downgoing signal from the computing system 400 to the switch 140 in the third (e.g., lower) perforating gun 130, as at 316. In response to this third downgoing signal, the switch 140 may actuate into a third position that connects the computing system 400 with the second pyrotechnic device (e.g., the detonator) 142. In another embodiment, a single third downgoing signal may not actuate the switch 140 (e.g., for safety reasons), and the computing system 400 may instead transmit two separate third downgoing signals that cause the switch 140 to actuate into the second position after both third downgoing signals are received.

Once the switch 140 in the third (e.g., lower) perforating gun 130 actuates into the third position, power may be supplied from the surface, through the switch 140, and to the second pyrotechnic device (e.g., the detonator) 142. When the second pyrotechnic device (e.g., the detonator) 142 receives the power, the second pyrotechnic device (e.g., the detonator) 142 may detonate one of the charges 136 in the third (e.g., lower) perforating gun 130.

In at least one embodiment, rather than having one identity (e.g., address) with first and second switch positions, the switch 140 may include two separate identities (e.g., addresses). The first identity (e.g., address) may be used to cause the switch 140 to connect the computing system 400 to the first pyrotechnic device (e.g., the ignitor) 152, and the second identity (e.g., address) may be used to cause the switch 140 to connect the computing system 400 to the second pyrotechnic device (e.g., the detonator) 142.

The method 300 may then include transmitting one or more signals from the computing system 400 to the switch in the second (e.g., intermediate) perforating gun 120, as at 318. For example, a first downgoing signal may be transmitted from the computing system 400 to the switch in the second (e.g., intermediate) perforating gun 120. In response to this first downgoing signal, the computing system 400 may receive an upgoing signal indicating an identity (e.g., an address) of the switch in the second (e.g., intermediate) perforating gun 120. The computing system 400 may then transmit a second downgoing signal to the switch in the second (e.g., intermediate) perforating gun 120. In response to this second downgoing signal, the switch may actuate into a third position that connects the computing system 400 with the detonator in the second (e.g., intermediate) perforating gun 120. In another embodiment, a single second downgoing signal may not actuate the switch (e.g., for safety reasons), and the computing system 400 may instead transmit two separate second downgoing signals that cause the switch to actuate into the second position after both second downgoing signals are received.

Once the switch in the second (e.g., intermediate) perforating gun 120 actuates into the third position, power may be supplied from the surface, through the switch, and to the detonator in the second (e.g., intermediate) perforating gun 120. When the detonator receives the power, the detonator may detonate one of the charges in the second (e.g., intermediate) perforating gun 120.

The method 300 may then include transmitting one or more signals from the computing system 400 to the switch in the third (e.g., upper) perforating gun 110, as at 320. For example, a first downgoing signal may be transmitted from the computing system 400 to the switch in the third (e.g., upper) perforating gun 110. In response to this first downgoing signal, the computing system 400 may receive an upgoing signal indicating an identity (e.g., an address) of the switch in the third (e.g., upper) perforating gun 110. The computing system 400 may then transmit a second downgoing signal to the switch in the third (e.g., upper) perforating gun 110. In response to this second downgoing signal, the switch may actuate into a third position that connects the computing system 400 with the detonator in the third (e.g., upper) perforating gun 110. In another embodiment, a single second downgoing signal may not actuate the switch (e.g., for safety reasons), and the computing system 400 may instead transmit two separate second downgoing signals that cause the switch to actuate into the second position after both second downgoing signals are received.

Once the switch in the third (e.g., upper) perforating gun 110 actuates into the third position, power may be supplied from the surface, through the switch, and to the detonator in the third (e.g., upper) perforating gun 110. When the detonator receives the power, the detonator may detonate one of the charges in the third (e.g., upper) perforating gun 110.

Figure 4:
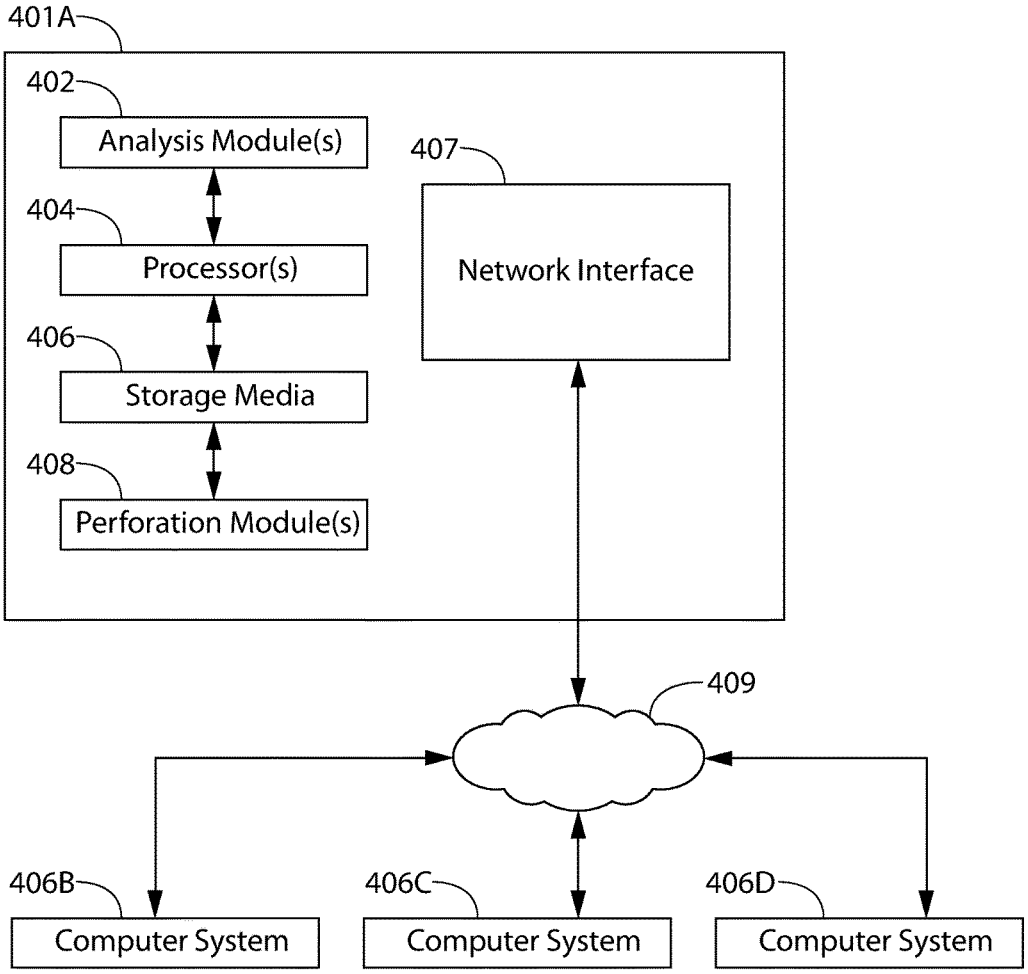
FIG. 4 illustrates a schematic view of a computing system for performing at least a portion of the method, according to an embodiment.

In some embodiments, the methods of the present disclosure may be executed by a computing system. FIG. 4 illustrates an example of such a computing system 400, in accordance with some embodiments. The computing system 400 may include a computer or computer system 401A, which may be an individual computer system 401A or an arrangement of distributed computer systems. The computer system 401A includes one or more analysis modules 402 that are configured to perform various tasks according to some embodiments, such as one or more methods disclosed herein. To perform these various tasks, the analysis module 402 executes independently, or in coordination with, one or more processors 404, which is (or are) connected to one or more storage media 406. The processor(s) 404 is (or are) also connected to a network interface 407 to allow the computer system 401A to communicate over a data network 409 with one or more additional computer systems and/or computing systems, such as 401B, 401C, and/or 401D (note that computer systems 401B, 401C and/or 401D may or may not share the same architecture as computer system 401A, and may be located in different physical locations, e.g., computer systems 401A and 401B may be located in a processing facility, while in communication with one or more computer systems such as 401C and/or 401D that are located in one or more data centers, and/or located in varying countries on different continents).

A processor may include a microprocessor, microcontroller, processor module or subsystem, programmable integrated circuit, programmable gate array, or another control or computing device.

The storage media 406 may be implemented as one or more computer-readable or machine-readable storage media. Note that while in the example embodiment of FIG. 4 storage media 406 is depicted as within computer system 401A, in some embodiments, storage media 406 may be distributed within and/or across multiple internal and/or external enclosures of computing system 401A and/or additional computing systems. Storage media 406 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-RAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 400 contains one or more perforation module(s) 408. The perforation module(s) 408 may be used to perform at least a portion of one or more embodiments of the methods disclosed herein (e.g., method 300).

It should be appreciated that computing system 400 is only one example of a computing system, and that computing system 400 may have more or fewer components than shown, may combine additional components not depicted in the example embodiment of FIG. 4, and/or computing system 400 may have a different configuration or arrangement of the components depicted in FIG. 4. The various components shown in FIG. 4 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A perforating gun, comprising:

a carrier;

an explosive charge positioned within the carrier;

a detonator positioned within the carrier, wherein the detonator detonates the explosive charge when the detonator receives power; and a switch positioned within the carrier and configured to actuate between at least a first position and a second position, wherein the switch transmits power to the detonator when the switch is in the first position, wherein the switch transmits power to a pyrotechnic device when the switch is in the second position, and wherein the pyrotechnic device detonates or deflagrates when the pyrotechnic device receives power, wherein the pyrotechnic device comprises an ignitor that causes a plug to actuate from a first state to a second state in response to the ignitor deflagrating.

2. The perforating gun of claim 1, wherein the switch is also configured to actuate into a third position.

3. The perforating gun of claim 2, wherein the switch does not transmit power to the detonator or the pyrotechnic device when the switch is in the third position.

4. The perforating gun of claim 2, wherein the switch transmits power to a motor, a release mechanism, or a measurement tool when the switch is in the third position.

5. The perforating gun of claim 1, further comprising a body configured to be inserted into the carrier, wherein the switch and the detonator are positioned within the body.

6. The perforating gun of claim 1, wherein the power is transmitted from the switch in the second position to the pyrotechnic device without passing through an intermediate switch.

7. The perforating gun of claim 1, wherein the pyrotechnic device is not positioned within the carrier.

8. The perforating gun of claim 1, wherein the pyrotechnic device is different from the detonator and the explosive charge.

9. A downhole tool, comprising:

a first perforating gun comprising:

a carrier;

an explosive charge positioned within the carrier;

a detonator positioned within the carrier, wherein the detonator detonates the explosive charge when the detonator receives power; and a switch positioned within the carrier and configured to actuate between at least a first position and a second position, wherein the switch transmits power to the detonator when the switch is in the first position, wherein the switch transmits power to an ignitor when the switch is in the second position;

a setting tool coupled the first perforating gun, wherein the setting tool has the ignitor positioned therein; and a plug coupled to the setting tool, wherein the ignitor causes the plug to actuate from a first state to a second state when the ignitor receives power.

10. The downhole tool of claim 9, further comprising a second perforating gun comprising:

a carrier;

an explosive charge positioned within the carrier;

a detonator positioned within the carrier, wherein the detonator detonates the explosive charge when the detonator receives power; and a switch positioned within the carrier and configured to actuate between at least a first position and a second position, wherein the switch transmits power to the detonator when the switch is in the first position, wherein switch connects a computing system at the surface to the first perforating gun when the switch is in the second position.

11. The downhole tool of claim 10, wherein the first perforating gun is positioned between the second perforating gun and the plug.

12. The downhole tool of claim 9, wherein the switch in the first perforating gun is also configured to actuate into a third position, and wherein the switch in the first perforating gun does not transmit power to the detonator or the ignitor when the switch in the first perforating gun is in the third position.

13. The downhole tool of claim 9, wherein the power is transmitted from the switch of the first perforating gun to the ignitor without passing through an intermediate switch.

14. A method for operating a downhole tool, comprising:

running a downhole tool into a wellbore, wherein the downhole tool comprises:

a first perforating gun;

a setting tool; and a plug;

transmitting a first signal from a computing system to a first switch in the first perforating gun, wherein the first switch actuates into a first position that transmits power to a first pyrotechnic device in response to receiving the first signal, and wherein the first pyrotechnic device causes the plug to actuate from a first state to a second state when the first pyrotechnic device receives power; and transmitting a second signal from the computing system to the first switch in the first perforating gun, wherein the first switch actuates into a second position that transmits power to a second pyrotechnic device in response to receiving the second signal, and wherein the second pyrotechnic device causes a charge in the first perforating gun to explode when the second pyrotechnic device receives power.

15. The method of claim 14, wherein the first pyrotechnic device comprises an ignitor, and the second pyrotechnic device comprises a detonator.

16. The method of claim 15, wherein the ignitor is positioned in the setting tool, and the detonator is positioned in the first perforating gun.

17. The method of claim 14, wherein the downhole tool further comprises a second perforating gun positioned above the first perforating gun, and wherein the method further comprises transmitting a third signal from the computing system to a second switch in the second perforating gun before the first signal is transmitted to the first switch in the first perforating gun, wherein the second switch actuates into a first position that places the computing system in communication with the first switch in response to receiving the third signal.

18. The method of claim 17, further comprising transmitting a fourth signal from the computing system to the second switch after the second signal is transmitted to the first switch, wherein the second switch actuates into a second position that transmits power to a detonator in the second perforating gun in response to receiving the fourth signal, and wherein the detonator in the second perforating gun causes a charge in the second perforating gun to explode when the detonator in the second perforating gun receives power.

* * * * *